United States Patent [19]

Nicholson et al.

[11] Patent Number: 4,580,765

[45] Date of Patent: Apr. 8, 1986

[54] COMPACTION MACHINE

[75] Inventors: Robert G. Nicholson; Stephen J. Atkinson, both of North Humberside, England

[73] Assignee: Priestman Brothers Limited, England

[21] Appl. No.: 583,347

[22] Filed: Feb. 24, 1984

[51] Int. Cl.[4] ..... B66D 1/48

[52] U.S. Cl. ..... 254/276; 173/87; 254/375

[58] Field of Search ..... 404/133; 254/276, 266, 254/375, 366, 378; 173/87, 89, 81

[56] References Cited

U.S. PATENT DOCUMENTS

| | | | |
|---|---|---|---|
| 2,482,705 | 9/1949 | Cotton | 254/276 |
| 3,067,657 | 12/1962 | Wiekhorst | 404/133 |
| 3,938,595 | 2/1976 | Swenson | 173/87 X |
| 4,002,211 | 1/1977 | Holland | 173/87 |
| 4,004,779 | 1/1977 | Flesburg | 254/366 |
| 4,047,311 | 9/1977 | Kelley | 254/276 |
| 4,361,312 | 11/1982 | Schreyer et al. | 254/276 |

*Primary Examiner*—Stuart S. Levy
*Assistant Examiner*—Katherine Matecki
*Attorney, Agent, or Firm*—Finnegan, Henderson, Farabow, Garrett & Dunner

[57] ABSTRACT

The invention relates to a machine for dropping heavy weights on the ground for carrying out processes of dynamic compaction or dynamic consolidation wherein a brake is provided on the hoist drum which can be actuated automatically after a given period of time has elapsed after the release of the hoist drum brake to drop the weight.

4 Claims, 3 Drawing Figures

COMPACTION MACHINE

BACKGROUND OF THE INVENTION

The present invention relates to machines for dropping heavy weights on the ground for carrying out processes of dynamic compaction or dynamic consolidation.

In recent years a process known as dynamic compaction or dynamic consolidation has become widely used for preparing foundation soil prior to construction work taking place. Dynamic compaction or consolidation involves dropping a heavy flat-bottomed weight onto the ground, one or more times from a suitable height. The energy of the impact causes a restructuring of the soil structure and the dropping of the weight is carried out in a predetermined pattern over the ground to be consolidated.

To achieve the correct effect on the ground during dynamic compaction processes the weight must fall freely until it strikes the earth, at which point the rope drum is, of course rotating at a considerably faster speed than, say, when hoisting the weight back up. Once the weight has reached the ground it is necessary to stop further uncoiling of the hoist rope from the hoist drum to avoid slackness and possibly even tangling of the rope and although this can be carried out by the operator using his normal brake, this is most undesirable. Using the operator's normal brake to stop excessive uncoiling of the hoist rope is inaccurate because the operator has to judge the time for operation of the brake extremely accurately, failing which there is either late braking causing excessive uncoiling or, more seriously, early braking which slows the weight prematurely before it reaches the ground. Early braking is also extremely dangerous as the operator's normal brake is usually servo-assisted and if the operator does brake the hoist rope early then the crane may be seriously damaged if the hoist rope stays intact, as could normally be expected to happen, when the weight is stopped during its fall to the ground.

SUMMARY OF THE INVENTION

In order to overcome this problem and in accordance with the present invention a machine for dropping a heavy weight onto the ground in a process of dynamic compaction, has a boom or jib and a hoist rope wound on a hoist drum extending from the boom or jib and in use carrying the weight at its free end, the drum having first and second brakes, one for stopping unwinding of the hoist rope, which is arranged selectively to be actuated automatically after a given period of time has elapsed after the release of the hoist drum brake to drop the weight, and the other to hold the drum and maintain the weight above the ground.

Preferably, as this automatically actuated brake is not required to support the full load of the weight on the end of the hoist drum, it can be non-servo operated so as to be incapable of stopping the falling of the weight completely, and thus, effectively, being fail-safe to prevent damage occuring should actuation occur early.

By means of the use of such an automatic brake the inaccuracies involved in operator actuation can be overcome and the machinery made considerably safer. In addition to the automatic brake the operator can be provided with the conventional brake, the second brake identified above, in order to enable holding of the weight at lower heights than that from which it is normally dropped, for example, for purposes of tamping the surface prior to carrying out the compaction proper or for other positioning purposes.

Preferably, a conventional pneumatic control system will be supplemented by additional elements to operate the automatically actuated brake, elements including a pneumatic timer controllable to adjust the length of time from initiation of the timer to actuation, initiation of the timer being achieved, for example, automatically by release of the hoist drum clutch which thus frees the drum to enable the weight to fall to the ground.

BRIEF DESCRIPTION OF THE DRAWINGS

One example of a machine according to the present invention will now be described with reference to the accompanying drawings in which.

DESCRIPTION OF THE PREFERRED EMBODIMENT

Figure 1A:
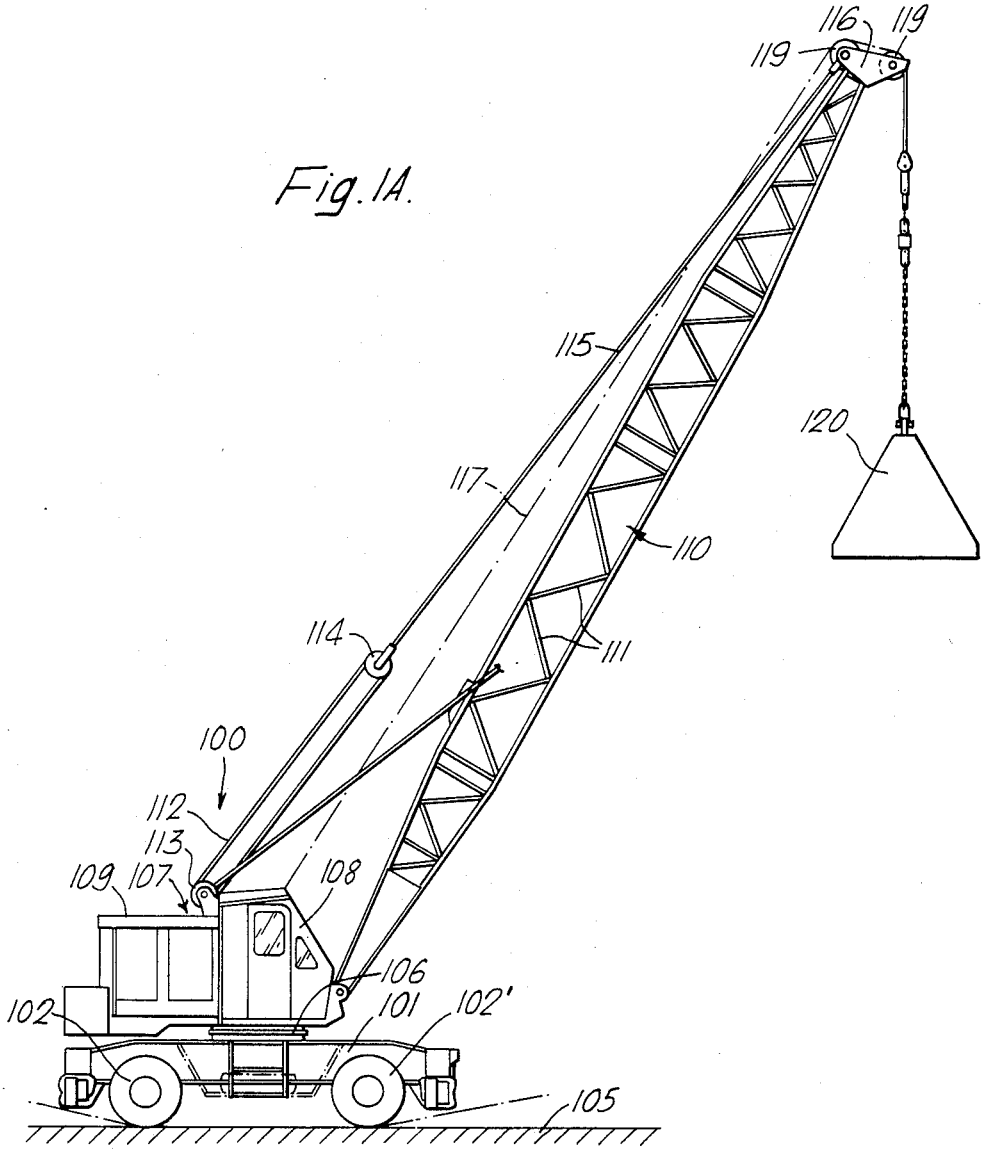
FIGS. 1A and 1B are a side elevation and partial front elevation respectively of a machine according to the present invention.
Figure 1B:
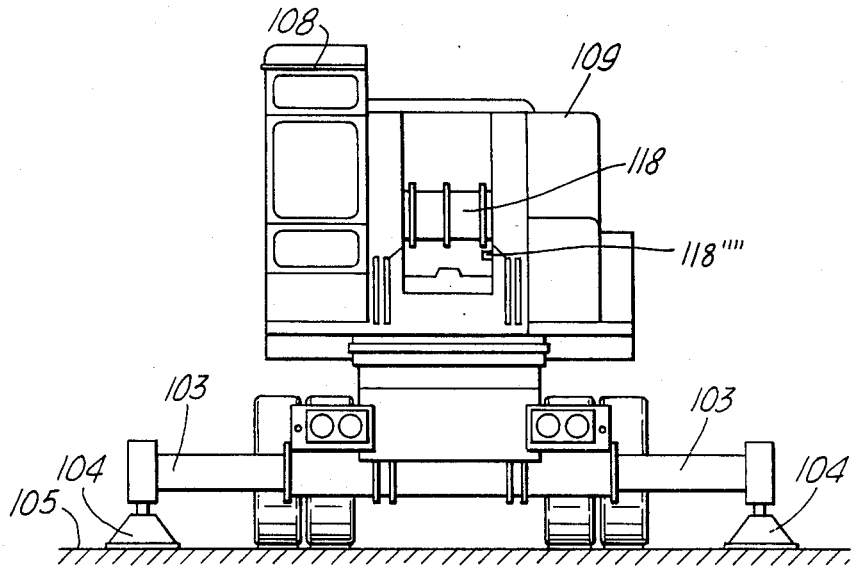

The machine 100 is similar to a conventional crane and comprises a wheeled chassis 101 having a pair of axles 102 and wheels 102' at each corner of the chassis 101, and extendable outriggers 103, each of which is adapted to carry a retractable foot 104 and is actuatable to engage the ground 105 to obtain a secure and stable positioning of the machine 100. On the chassis 101 is mounted a slew-ring 106 on which in turn is mounted a superstructure 107 consisting of an operator's cabin 108 and an engine and winch housing 109.

Pivotally mounted at the front of the superstructure 107 is a jib 110 consisting of a conventional lattice girder structure 111. The angle of the jib 110 is selectively variable in the conventional manner, by means of a jib rope 112 acting over pulleys 113, 114, the pulley 114 being mounted at the lower end of a tension element 115 connected to the head 116 of the jib 110. A hoist cable 117 is wound on hoist drum 118 and extends around pulleys 119 mounted on the jib head 116. A large and heavy compaction weight 120 is attached to the free end of the hoist rope 117 for raising and dropping onto the ground 105 for compaction purposes.

The present machine is capable of operating as a conventional crane as well as carrying out compaction duties and accordingly a control system 121 is provided to enable both functions to be fulfilled.

Figure 2:
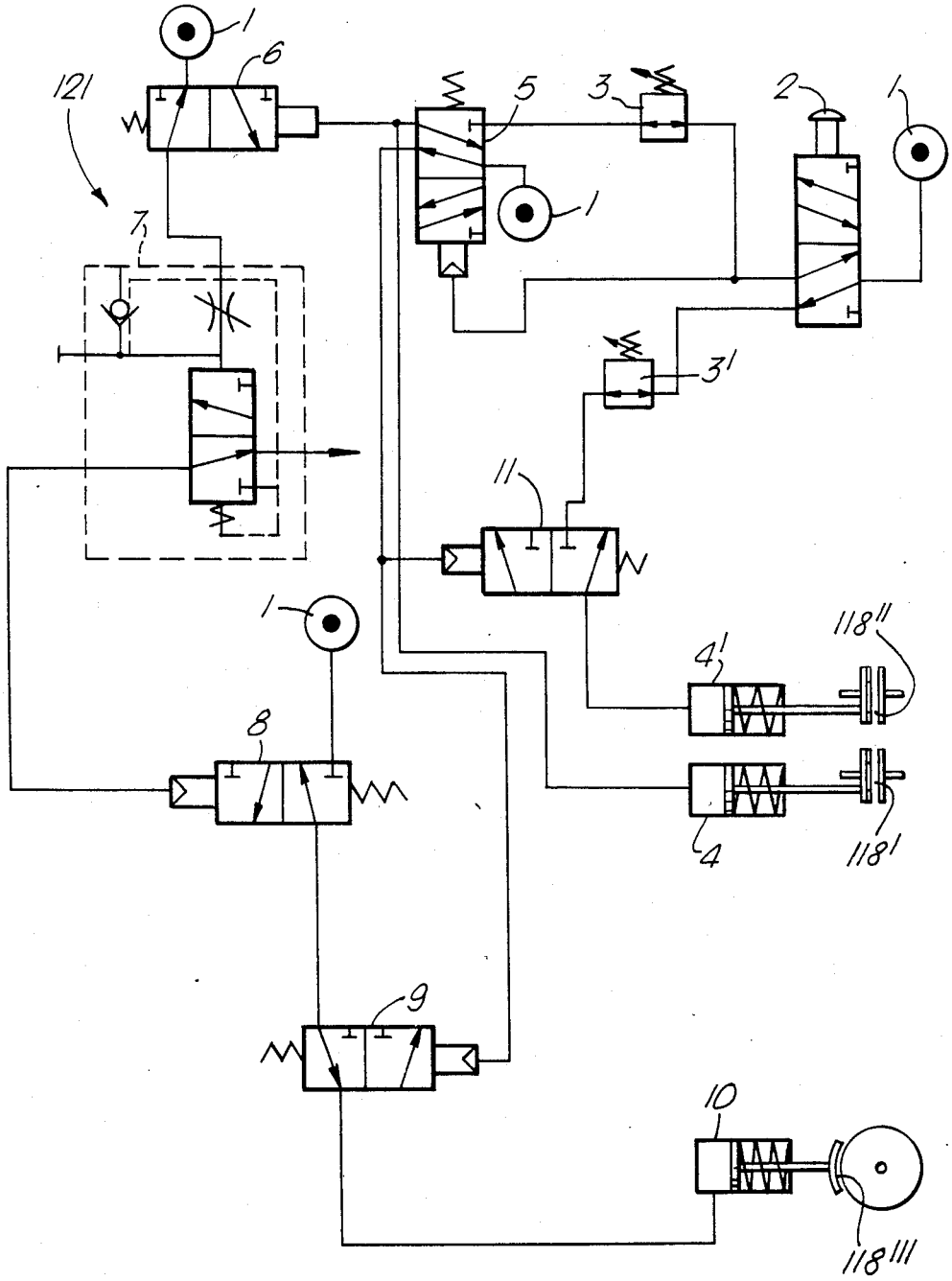
FIG. 2 is a schematic diagram of the brake control system therefor.

The machine 100 is provided with a control system, shown in FIG. 2, to which a source of compressed air 1 is provided when the machine is in operation. A main compactor/crane selector valve 2 selects either compaction duties or conventional crane operation. A first main control valve 3 is used to select operation of a first hoist drum clutch 118' through a respective actuator 4 in order to raise the load. The way in which this is done will be described hereinafter in further detail. A second main control valve 3' is provided to control operation of a second hoist drum clutch actuator 4' when the selector valve 2 is in the position (as shown) selecting crane operation. Thus, the actuator 4 is provided for actuating the one clutch 118' during compacting operations and the actuator 4' is provided for actuating a second clutch 118'' during normal crane duties.

If compactor operation has been selected on the valve 2, compressed air is provided not only to the main control valve 3 but also to actuate a valve 5 (shown in the non-actuated position), the valve 5 providing an interlock means to prevent actuation of the first hoist drum brake 118''' (as will be described later) when crane duties are selected on the valve 2. When the valve 5 is actuated, compressed air is passed further to the pilot of a valve 6 to cut off the supply of compressed air from the source 1 which is being supplied through the valve 6 to a timer valve assembly 7. This in turn exhausts air from the pilot of a valve 8, one side of which is again supplied from the source 1. Removal of the source of air to the pilot of the valve 8 causes that valve to move to the position shown to cut off supply of air from the source 1 through a further valve 9 to the actuator 10 of a first hoist drum brake 118''', the actuator 10 being released under spring pressure to disengage the brake. At the same time, compressed air from the main control valve 3 passing through the actuated valve 5 passes to the first hoist drum clutch actuator 4 so that the clutch 118' is engaged and the hoist cable 117 can be wound in and the weight 120 raised.

Once the weight has been raised to the required height, the control valve 3 is released, cutting off the supply of air through the valve 5 to the pilot of the valve 6, thus deactuating the valve 6 and allowing mains pressure air from the source 1 to be passed to the time valve assembly 7 which begins to fill with air. After a pre-adjusted time delay the air is released from the timer valve assembly into the pilot of the valve 8 which is thus actuated and in turn to allow mains pressure air from the source 1 to pass through the valve 8 to the valve 9, through the valve 9 and to the brake actuator 10 to cause brake 118''' to brake the drum 118. The time delay of the valve assembly 7 is adjusted according to the height chosen for dropping the weight 120 onto the ground. They cycle is repeated as often as required during the compacting process.

When conventional crane operation is selected on the selector valve 2, no air can be provided to the main control valve 3 so that the valve 5 will remain deactivated in the position shown, air thus being supplied to the pilots of valve 9 and a valve 11. Valve 9 is thus actuated so that although air is passed from the source 1 through the valve 6 to the timer valve assembly 7 and thus to the pilot valve 8, regardless of the position of the valve 8, air from the source 1 which passes through the valve 8 is cut. off at the valve 9 and thus prevented from reaching the brake actuator 10 to prevent actuation of the first hoist drum brake 118'''. The air supplied through the valve 5 to the pilot of the valve 11 causes that valve to be actuated so that actuation of the main control valve 3' can operate the second hoist drum clutch actuator 4' for normal crane operation.

A second, servo-assisted hoist drum brake 118'''' which is used during normal crane operation may be available for actuation at any time, regardless of the position of the selector valve 2, in order to hold the weight at a given position during its raising.

We claim:

1. A machine for dropping a heavy weight from a predetermined height above the ground onto the ground to effect dynamic compaction, said machine comprising:

a jib;

a hoist drum;

a hoist rope, one end of which is wound on said hoist drum and the other end of which extends over said jib and connects to said weight;

first and second brakes selectively engageable with said hoist drum, said first brake being servo-assisted to hold said drum and thereby suspend said weight above the ground, and said second brake being non-servo-assisted to stop the unwinding of said hoist drum after a preset period of time substantially equal to the time required for said weight to fall from said predetermined height; and control means for sensing the dropping of said weight and for actuating said second non-servo-assisted brake after said preset period of time.

2. A machine according to claim 1, wherein said control means comprises a hydraulically-operated control system and a main selector valve selectively actuatable to engage said hydraulically-operated control system, said control system including first control elements for enabling conventional cranage operations and second control elements for enabling compaction operations, said first control elements further including interlock means to prevent actuation of said second non-servo-assisted brake when said main selector valve is actuated for conventional cranage operations.

3. A machine according to claim 1, wherein said control means includes a pneumatic control system and a pneumatic timer coupled to said pneumatic control system to control actuation of the said second brake, said timer being selectively adjustable to control the length of time from initiation of said timer to actuation of said first brake.

4. A machine according to claim 3 further comprising a hoist drum clutch and means for initiating said pneumatic timer automatically by release of said hoist drum clutch.

* * * * *